US009207633B2

(12) United States Patent
Okamoto

(10) Patent No.: US 9,207,633 B2
(45) Date of Patent: Dec. 8, 2015

(54) FIXING DEVICE AND IMAGE FORMING APPARATUS INCORPORATING SAME

(71) Applicant: Masami Okamoto, Kanagawa (JP)

(72) Inventor: Masami Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/463,941

(22) Filed: Aug. 20, 2014

(65) Prior Publication Data

US 2015/0093128 A1 Apr. 2, 2015

(30) Foreign Application Priority Data

Sep. 27, 2013 (JP) ..... 2013-202567
Feb. 6, 2014 (JP) ..... 2014-021701

(51) Int. Cl.
*G03G 15/20* (2006.01)
*G03G 21/16* (2006.01)
*G03G 15/00* (2006.01)

(52) U.S. Cl.
CPC ..... *G03G 21/1685* (2013.01); *G03G 15/2025* (2013.01); *G03G 15/553* (2013.01)

(58) Field of Classification Search
CPC ..... G03G 21/1685; G03G 15/553
USPC ..... 399/33
See application file for complete search history.

(56) References Cited

U.S. PATENT DOCUMENTS 5,678,134 A * 10/1997 Miki et al. ..... 399/71
7,460,821 B2 * 12/2008 Ai et al. ..... 399/328
2010/0310288 A1 * 12/2010 Takagi et al. ..... 399/327
2011/0222924 A1 * 9/2011 Aoyama et al. ..... 399/327
2012/0251153 A1 * 10/2012 Takada ..... 399/68

FOREIGN PATENT DOCUMENTS

| | | |
|---|---|---|
| JP | 2000-347519 | 12/2000 |
| JP | 2004-212714 | 7/2004 |
| JP | 2006-317881 | 11/2006 |
| JP | 2007-034068 | 2/2007 |
| JP | 2008-020790 | 1/2008 |
| JP | 2008-040364 | 2/2008 |
| JP | 2008-268524 | 11/2008 |
| JP | 2008-268606 | 11/2008 |
| JP | 2009-237250 | 10/2009 |
| JP | 2010-139701 | 6/2010 |
| JP | 2011-123333 | 6/2011 |
| JP | 2011-175065 | 9/2011 |

* cited by examiner

*Primary Examiner* — Francis Gray
(74) *Attorney, Agent, or Firm* — Harness, Dickey & Pierce

(57) ABSTRACT

A fixing device includes a rotary fixing member, a sensor, a grinder, and a controller. The rotary fixing member fixes an image on a recording medium. The sensor detects a surface state of the rotary fixing member. The grinder is disposed opposite the rotary fixing member to slide against a surface of the rotary fixing member and grind the surface of the rotary fixing member. The controller controls the grinder to contact or separate from the rotary fixing member, in accordance with a detection result of the surface state detected with the sensor in a recording medium edge passage area of the rotary fixing member over which an edge of a recording medium passes in a direction perpendicular to a feed direction of the recording medium fed with rotation of the rotary fixing member.

20 Claims, 8 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-202567, filed on Sep. 27, 2013, and 2014-021701, filed on Feb. 6, 2014 in the Japan Patent Office, the entire disclosure of each of which is hereby incorporated by reference herein.

BACKGROUND

1. Technical Field

Embodiments of this disclosure relate to a fixing device including a rotary fixing member to fix an image to a recording medium and an image forming apparatus incorporating the fixing device.

2. Description of the Related Art

Image forming apparatuses are used as, for example, copiers, printers, and facsimile machines employing electrophotographic techniques, or multifunction peripherals having at least one of copying, printing, and facsimile functions. Such electrophotographic image forming apparatuses may employ a fixing device including a fixing member (e.g., a fixing belt) to fix a toner image on a recording medium. Such a fixing device may include a grinding member to grind a surface of the fixing member to recover a surface state suitable for fixing operation. For example, a grinding member removes scratches of a fixing member, which are caused by a separation pawl provided near the fixing member, so as not to be noticeable. Alternatively, a grinding member recovers the surface roughness of a fixing member occurring in a passage area of an edge of a recording medium. Further, the passage number of recording media is counted, and the grinding member performs grinding operation after a print job ends and at a timing at which the counted number reaches a predetermined number.

Further, as an example of the control of grinding operation of such a grinding member, a control method is known which counts the passage number of recording media, finishes print operation at a timing at which the counted number becomes a predetermined number, and performs grinding operation. Alternatively, a control method is known which determines whether to perform grinding operation depending on whether the number of recording media on which images have been fixed and the number of recording media on which fixing operation is to be performed exceed a predetermined number.

SUMMARY

In at least one embodiment of this disclosure, there is provided an improved fixing device including a rotary fixing member, a sensor, a grinder, and a controller. The rotary fixing member fixes an image on a recording medium. The sensor detects a surface state of the rotary fixing member. The grinder is disposed opposite the rotary fixing member to slide against a surface of the rotary fixing member and grind the surface of the rotary fixing member. The controller controls the grinder to contact or separate from the rotary fixing member, in accordance with a detection result of the surface state detected with the sensor in a recording medium edge passage area of the rotary fixing member over which an edge of a recording medium passes in a direction perpendicular to a feed direction of the recording medium fed with rotation of the rotary fixing member.

In at least one embodiment of this disclosure, there is provided an improved image forming apparatus including an image forming unit to form an image and the above-described fixing device to fix the image on a recording medium.

In at least one embodiment of this disclosure, there is provided an improved fixing device including a rotary fixing member, a sensor, a grinder, and a controller. The rotary fixing member fixes an image on a recording medium. The sensor detects a surface state of the rotary fixing member. The grinder is disposed opposite the rotary fixing member to slide against a surface of the rotary fixing member and grind the surface of the rotary fixing member. The controller controls the grinder to contact or separate from the rotary fixing member. The controller changes a rotation speed of the rotary fixing member in a grinding operation in response to a detection result of the surface state before and after the grinding operation.

In at least one embodiment of this disclosure, there is provided an improved image forming apparatus including an image forming unit to form an image and the above-described fixing device to fix the image on a recording medium.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
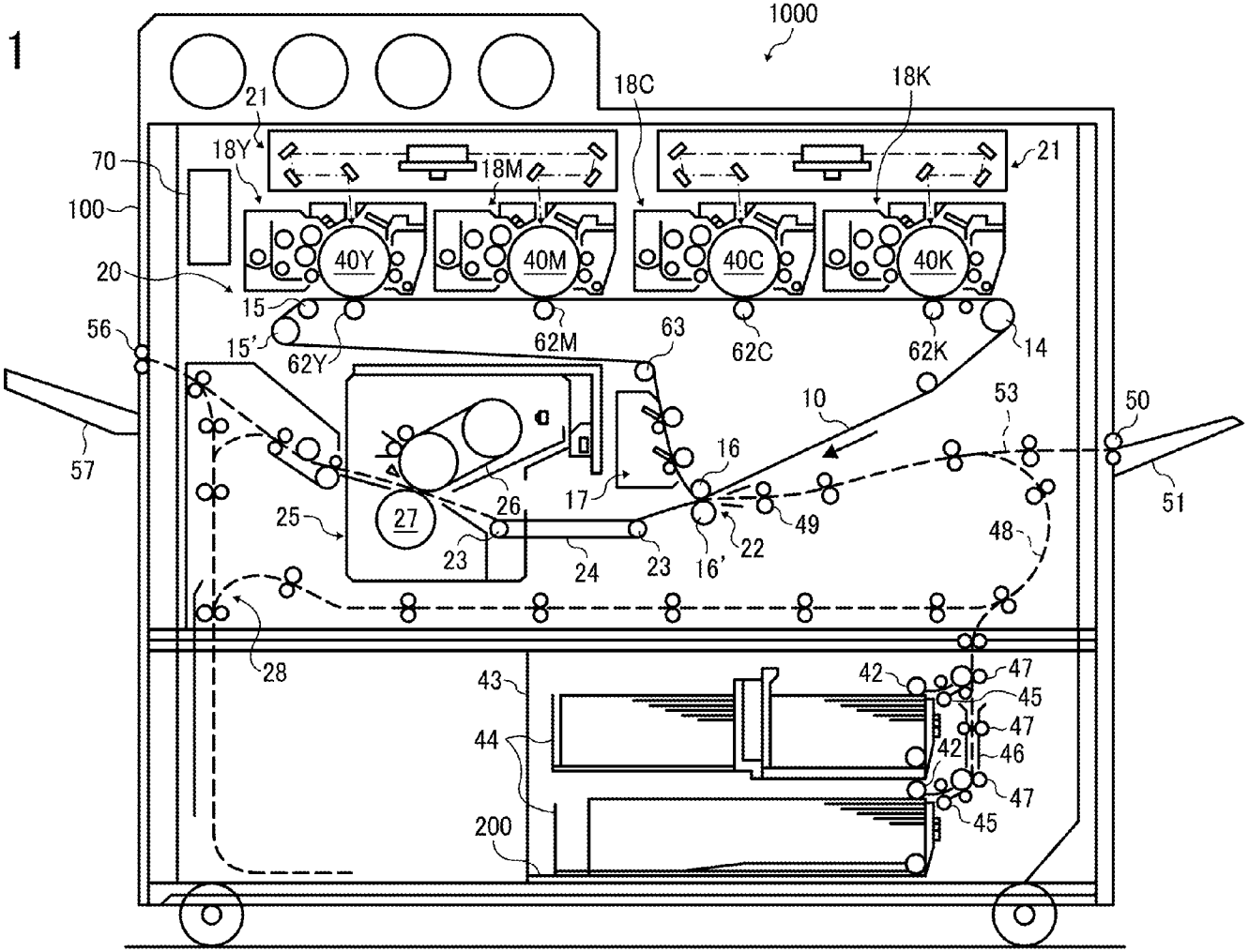
FIG. 1 is a schematic view of a configuration of an image forming apparatus according to an embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

In this specification, a recording media is also referred to as "sheet". It is to be noted that examples of the sheet in this specification include plain paper, various kinds of coated paper, thick paper such as a post card, various kinds of films such as an overhead projector (OHP) film, and various kinds of sheet-shaped recording media.

Referring now to the drawings, embodiments of the present disclosure are described below. In the drawings for explaining the following exemplary embodiments, the same reference codes are allocated to elements (members or components) having the same function or shape and redundant descriptions thereof are omitted below.

In grinding operation on a fixing member of a fixing device, the surface roughness of the fixing member caused by a recording medium edge largely changes depending on the type or the cut state of a recording medium (hereinafter, sheet). Particularly, for a sheet that is high in the burr height of the recording medium edge, an image failure is likely to occur. By contrast, for a sheet in which the burr of the edge hardly exists, the image failure caused by the edge hardly occurs and the number of passage sheets resulting in the image failure is not the same as in the case of the sheet having high burr. Accordingly, for a configuration in which grinding operation is performed at certain intervals, the grinding operation is performed even when the grinding operation is not substantially necessary, resulting in a reduction in the product life of the grinding member. Further, since the surface state of the fixing member is roughened, the number of passage sheets resulting in image failure also largely changes depending on the type of recording medium.

For this reason, for a configuration in which grinding operation is performed in accordance with the number of passage sheets, the grinding operation is performed even when the grinding operation is not substantially needed. As a result, the product life of the grinding member might be shortened.

In light of the above-described circumstances, embodiments of this disclosure provide a fixing device and an image forming apparatus capable of maintaining desired grinding performance for a long period without performing unnecessary grinding operation.

Below, a fixing device according to an embodiment of this disclosure is described in detail with reference to the accompanying drawings.

In this embodiment, the fixing device is used in, for example, an image forming apparatus, such as a copier and a facsimile, to form an image with toner and fixes a toner image on a recording medium (hereinafter, also referred to as "sheet").

FIG. 1 is a schematic view of a configuration of an example of an image forming apparatus 1000 according to an embodiment of this disclosure. The image forming apparatus 1000 of this embodiment is a tandem-type intermediate transfer system, and a sheet feed table 200 including a sheet feed tray 44 is provided at the lower portion thereof.

Further, a tandem-type image forming section 20 of a tandem-type intermediate transfer system in which a plurality of image forming units 18Y, 18M, 18C, and 18K is arranged in parallel is provided inside an apparatus body 100. The suffixes Y, M, C, and K given to the reference numerals respectively indicate the colors of yellow, magenta, cyan, and black.

An intermediate transfer body (hereinafter, referred to as an intermediate transfer belt) 10 having a shape of endless belt is provided in the vicinity of the center of the apparatus body 100. The intermediate transfer belt 10 is wound around and supported by a plurality of rollers 14, 15, 15', and 16 to convey a sheet while rotating in a clockwise direction of FIG. 1.

In the configuration of FIG. 1, an intermediate transfer belt cleaner 17 is provided at the left side of the secondary-transfer opposing roller 16 which is one of the support rollers. The cleaner 17 removes a residual toner which remains on the intermediate transfer belt 10 after an image is transferred.

Four image forming units 18Y, 18M, 18C, and 18K of yellow (Y), magenta (M), cyan (C), and black (K) are disposed above the intermediate transfer belt 10 stretched over the support roller 14 and the support roller 15 in the conveyance direction. Hereinafter, the image forming units 18Y, 18M, 18C, and 18K may be collectively referred to as the image forming units 18 unless distinguished.

In this way, the four image forming units 18Y, 18M, 18C, and 18K are disposed in parallel to each other in the lateral direction so as to form the tandem-type image forming section 20 as described above. The image forming units 18Y, 18M, 18C, and 18K of the tandem-type image forming section 20 respectively include photoconductor drums 40Y, 40M, 40C, and 40K which serve as image bearers to bear toner images of respective colors of yellow, magenta, cyan, and black.

Two exposure devices 21 are provided above the tandem-type image forming section 20 as illustrated in FIG. 1. Each of the exposure devices 21 is provided so as to correspond to two image forming units (e.g., 18Y and 18M, or 18C and 18K in FIG. 1). Each exposure device 21 is an exposure device of an optical scanning system including, for example, a light-source device such as a semiconductor laser, a semiconductor laser array, or a multi-beam light source, a coupling optical system, a common light deflector as a polygon mirror, and a two-channel scan imaging optical system. The exposure devices 21 form an electrostatic latent image by exposing the photoconductor drums 40Y, 40M, 40C, and 40K in response to the image information of respective colors of yellow, magenta, cyan, and black.

Further, the following members are provided around the photoconductor drums 40Y, 40M, 40C, and 40K of the image forming units 18Y, 18M, 18C, and 18K. The members correspond to a charging device which uniformly charges the photoconductor drums before the exposure, a developing device which develops an electrostatic latent image formed by the exposure by using the toners of respective colors, and a photoconductor cleaner which removes a post-transfer residual toner on the photoconductor drum.

Further, primary transfer rollers 62Y, 62M, 62C, and 62K are provided at a primary transfer position where the toner images are transferred from the photoconductor drums 40Y, 40M, 40C, and 40K to the intermediate transfer belt 10. The primary transfer rollers 62Y, 62M, 62C, and 62K are provided to oppose the photoconductor drums 40Y, 40M, 40C, and 40K, respectively, with the intermediate transfer belt 10 interposed therebetween, and constitute a primary transfer unit.

Among the plurality of support rollers supporting the intermediate transfer belt 10, the support roller 14 is a driving roller which rotates the intermediate transfer belt 10 and is connected to a motor via, for example, a drive transmission assembly such as a gear, a pulley, and a belt. Further, when a single color image of black is formed on the intermediate transfer belt 10, a moving assembly may move the support rollers 15 and 15' other than the support roller 14 to separate the photoconductor drums 40Y, 40M, and 40C from the intermediate transfer belt 10.

A secondary transfer device 22 is disposed opposite to the tandem-type image forming section 20 with the intermediate transfer belt 10 interposed therebetween. In the example of FIG. 1, the secondary transfer device 22 presses the secondary transfer roller 16' against the secondary-transfer opposing roller 16 and applies a transfer electric field thereto, so that the image on the intermediate transfer belt 10 is transferred to a sheet as a sheet-shaped recording medium.

Figure 2:
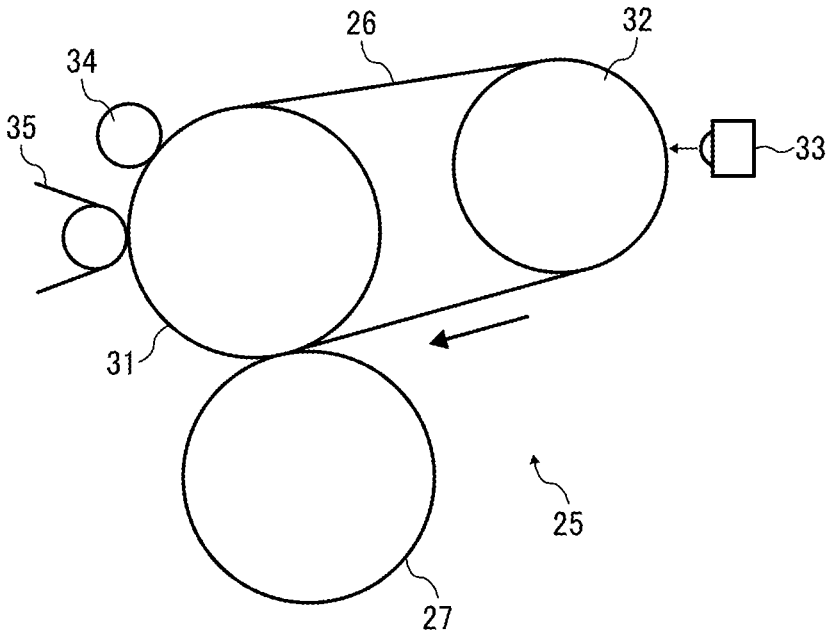
FIG. 2 is a schematic view of a configuration of a fixing device according to an embodiment of this disclosure.

Further, a fixing device 25 which fixes an image transferred onto the sheet is provided beside the secondary transfer device 22. As illustrated in FIG. 2, the fixing device 25 forms a nipping portion by pressing a pressing roller 27 against a fixing belt 26 as an endless belt, and fixes a toner image to the sheet. The fixing belt 26 is wound around two support rollers, and at least one roller is provided with, for example, a heating unit such as a heater, a lamp, or a heating device of an electromagnetic induction system. In the example of FIG. 2, two support rollers are indicated as a heating roller 32 with a heating unit and a fixing roller 31. The fixing belt 26 is pressed against the pressing roller 27 by the fixing roller 31, so that the above-described nipping portion is formed.

The sheet to which an image is transferred by the secondary transfer device 22 is conveyed to the fixing device 25 by a conveyance belt 24 supported by two rollers 23. Of course, the conveyance belt 24 may be a fixed guide member or a conveyance roller.

Furthermore, in the example of FIG. 1, a sheet reverse device 28 which reverses and conveys the sheet to record an image on both surfaces of the sheet and is parallel to the tandem-type image forming section 20 is provided below the secondary transfer device 22 and the fixing device 25.

Next, the fixing device 25 according to this embodiment is described in detail with reference to FIG. 2.

FIG. 2 is a schematic view of a configuration of the fixing device 25 according to this embodiment.

As illustrated in FIG. 2, the fixing device 25 of this embodiment includes an optical sensor 33, a grinding member 34, and a cleaning web 35 around the fixing belt 26.

The optical sensor 33 detects the surface state of the fixing belt 26 in each of a sheet passage area and a sheet edge passage area in a direction perpendicular to the feed direction in accordance with the rotation of the fixing belt 26. As described above, the sheet edge passage area is defined by the size of the sheet having an image formed thereon and conveyed by the fixing device 25 in the direction perpendicular to the feed direction in accordance with the rotation of the fixing belt 26.

The grinding member 34 serves as a grinder to contact the fixing belt 26 and grinds the surface of the fixing belt 26 while sliding against the surface. Accordingly, for example, even when a scratch is formed on the surface of the fixing belt 26, the surface state of the fixing belt 26 is recovered to a state where a fixing operation is performed very suitably. The position of the grinding member 34 may be switched so that the grinding member contacts or separates from the fixing belt 26 by a moving unit. The control of causing the grinding member to contact or separate from the fixing belt by the moving unit is performed by a controller 70 in the apparatus body 100.

The cleaning web 35 removes a residual toner remaining on the surface of the fixing belt 26.

In this way, the optical sensor 33 which serves as a detector detecting the surface state of the fixing belt 26 is provided at the downstream position in the feed direction in accordance with the rotation of the belt in relation to the grinding member 34 as the components around the fixing belt 26. The optical sensor 33 may detect the surface state in the sheet edge passage area and the sheet passage area of the fixing belt, and hence may detect the surface roughness of the fixing belt 26.

Next, an example of operation of the fixing device 25 according to an embodiment of this disclosure is described with reference to the flowchart of FIG. 3.

First, the controller 70 detects a sensor output V1 in the sheet edge passage area and a sensor output V2 in the sheet passage area in the surface of the fixing belt 26 from the optical sensor 33 (step S1 and step S2).

Then, a difference value V3 between V1 and V2 is set as below. When the difference value V3 of $V3=|V2-V1|$ is greater than a threshold value X1 (NO at step S3), the controller 70 causes the grinding member 34 to separate from the surface of the fixing belt 26 (step S4). That is, a control is performed so that the maintenance of the roughness of the surface of the fixing belt 26 is suspended.

When the difference value V3 is greater than the predetermined threshold value X1 (YES at step S3), the controller 70 determines the size of the recording medium having an image formed thereon in the apparatus body 100 (step S5). Then, the controller 70 controls the grinding member 34 to contact or separate from the fixing belt 26 for a predetermined time in response to the size of the recording medium. The size of the recording medium as the determination target herein is the sheet width in a direction perpendicular to the feed direction of the recording medium fed with the rotation of the fixing belt 26.

The size of the recording medium may be set based on the content input from an operation unit or may be automatically detected. As described above, an image is formed in accordance with the size of the recording medium obtained by the operation input or the automatic detection, and the sheet width of the sheet conveyed to the fixing device 25 in a direction perpendicular to the feed direction in accordance with the rotation of the fixing belt 26 is set.

When the difference value V3 is greater than the predetermined threshold value X1 at step S3 and the recording medium size of the subsequent passage sheet is greater than the size of the recording medium having an edge detected at step S1 (YES at step S6), the grinding member 34 starts to contact the fixing belt 26 before the recording medium passes through the fixing device 25 (step S7).

When the grinding member 34 contacts the fixing belt 26, the controller 70 performs a control in which the time for which the grinding member 34 contacts the fixing belt 26 is selected from a plurality of predetermined time values based on whether the difference value V3 is greater than a threshold value X2 (step S8). The threshold value X2 is set to a value greater than the threshold value X1 in advance.

For this reason, when the difference value V3 is greater than the threshold value X2 (YES at step S9), the time for which the grinding member 34 contacts the fixing belt 26 is set to a grinding time T1 (step S10). When the difference value V3 is not greater than the threshold value X2 (NOT at step S9), the time for which the grinding member 34 contacts the fixing belt 26 is set to a grinding time T2 shorter than the grinding time T1 (step S11). As described above, the threshold values X1 and X2 and the grinding times T1 and T2 respectively have the following relation. That is, a relation of threshold value X2>threshold value X1 is established, and a relation of grinding time T1>grinding time T2 is established.

Further, when the difference value V3 is larger than the predetermined threshold value X1 at step S3 and the recording medium size of the subsequent passage sheet is equal to or smaller than the size of the recording medium using the edge detection at step S1, the grinding member 34 is separated from the fixing belt without causing the grinding member 34 to contact the fixing belt before the recording medium passes through the fixing device (step S4). That is, a control is performed so that the maintenance of the roughness of the surface of the fixing belt 26 is suspended.

As described above, this embodiment is made so that the grinding performance of the grinding member is maintained for a long period of time in the fixing device including the grinding member capable of recovering the roughness of the surface of the fixing member generated by the passage of the recording medium.

For this reason, the fixing device 25 of this embodiment forms a nipping portion by the fixing belt 26 as the fixing member having a thermal fixing unit in at least one side thereof and the pressing roller 27 as the rotary body contacting the fixing belt 26. Then, the recording medium bearing an unfixed toner image is sandwiched and conveyed at the nipping portion so that an unfixed toner is fused and fixed.

The fixing device 25 includes the grinding member 34 and the optical sensor 33 as the detection unit. The grinding member 34 may recover the surface state suitable for the fixing operation by grinding the surface of the fixing member while sliding against the surface. The optical sensor 33 as the detection unit may detect the surface state of the edge passage area of the recording medium in the fixing member.

Further, the controller 70 determines whether to cause the grinding member to contact or separate from the fixing member in response to the detection result of the detection unit. Furthermore, when the recording medium size of the passage sheet is equal to or smaller than the size of the recording medium subjected the edge surface detection, the grinding member is not caused to contact the fixing member. Further, when the grinding member is caused to contact the fixing member, the time for which the grinding member contacts the fixing member may be selected in response to the detection result.

In this way, when the operation control is performed by using at least the detection result obtained by the optical sensor 33 in the recording medium edge passage area in a direction perpendicular to the feed direction in accordance with the rotation of the fixing member, the unnecessary grinding operation may not be performed. For this reason, the grinding operation using the grinding member 34 may be performed only at the necessary time, and hence the grinding performance may be maintained for a long period of time.

Further, when the surface state of the fixing member is fed back and the image failure caused by the surface roughness of the fixing member in the next print operation is predicted, the grinding operation is performed in advance for the next print operation.

The fixing device 25 of this embodiment uses the optical sensor 33 which detects the reflected light with respect to the emitted light as the detection unit detecting the surface state of the fixing belt 26. Then, the optical sensor 33 is configured to detect both the recording medium passage area and the recording medium edge passage area in a direction perpendicular to the feed direction in accordance with the rotation of the fixing belt 26.

Figure 4A:
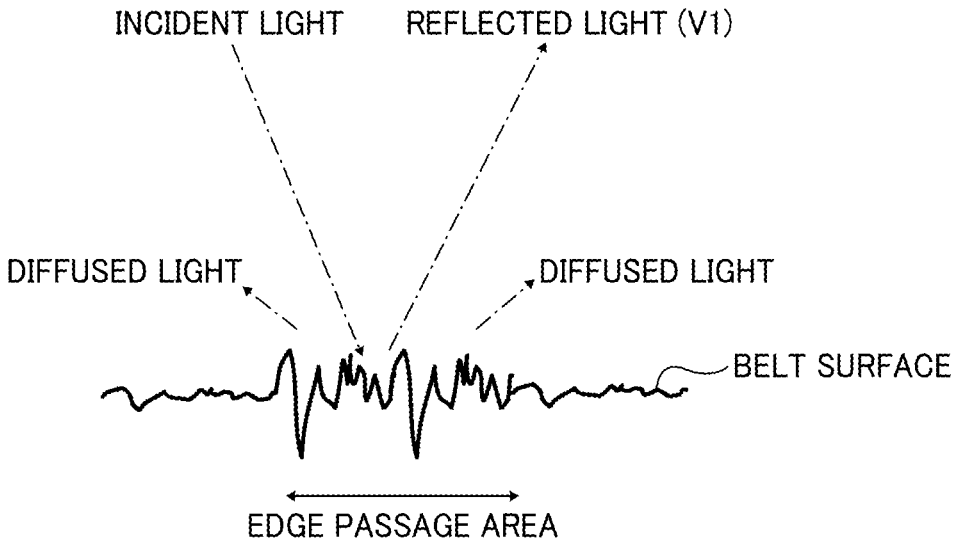
FIGS. 4A and 4B are diagrams illustrating an example of a surface state of the fixing belt and examples of incident light and reflected light according to an embodiment of this disclosure.
Figure 4B:
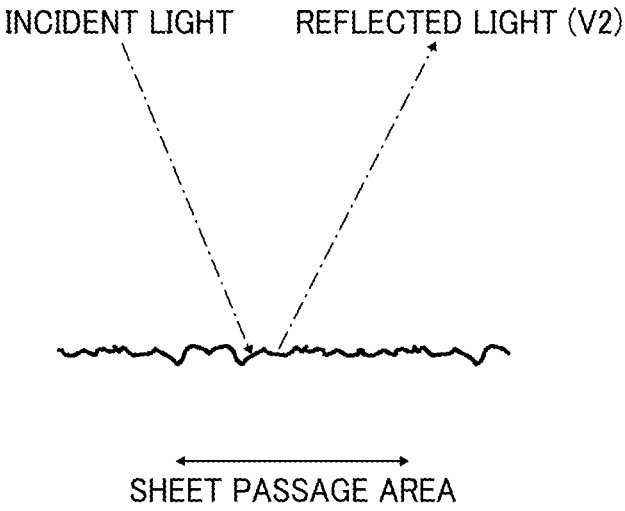

FIGS. 4A and 4B illustrate an example of the surface state of the fixing belt 26 in the sheet edge passage area and the sheet passage area. Since the optical sensor 33 detects the reflected light with respect to the incident light of the emitted light, the detection result in the sheet edge passage area becomes the sensor output V1 obtained by the detection of the reflected light illustrated in FIG. 4A. Further, the detection result of the sheet passage area becomes the sensor output V2 obtained by the detection of the reflected light illustrated in FIG. 4B.

The image failure caused by the sheet edge occurs due to a change in gloss between the edge and the sheet passage area in that the surface of the fixing belt is roughened by the sheet edge and the surface state is different between the sheet passage area and the edge. Thus, the roughness of the surface of the fixing belt may be detected by the intensity of the reflected light with respect to the emitted light using the optical sensor as the detection unit.

In this way, the controller 70 performs a control in which the detection result of the recording medium passage area and the detection result of the recording medium edge passage area are compared with each other and the grinding member is caused to contact or separate from the fixing member in response to the size of the recording medium as described above. For this reason, the highly precise edge detection may be performed. For this reason, the grinding operation may be performed only at the necessary time, and hence the grinding performance of the grinding member 34 may be maintained for a long period of time.

Figure 3:
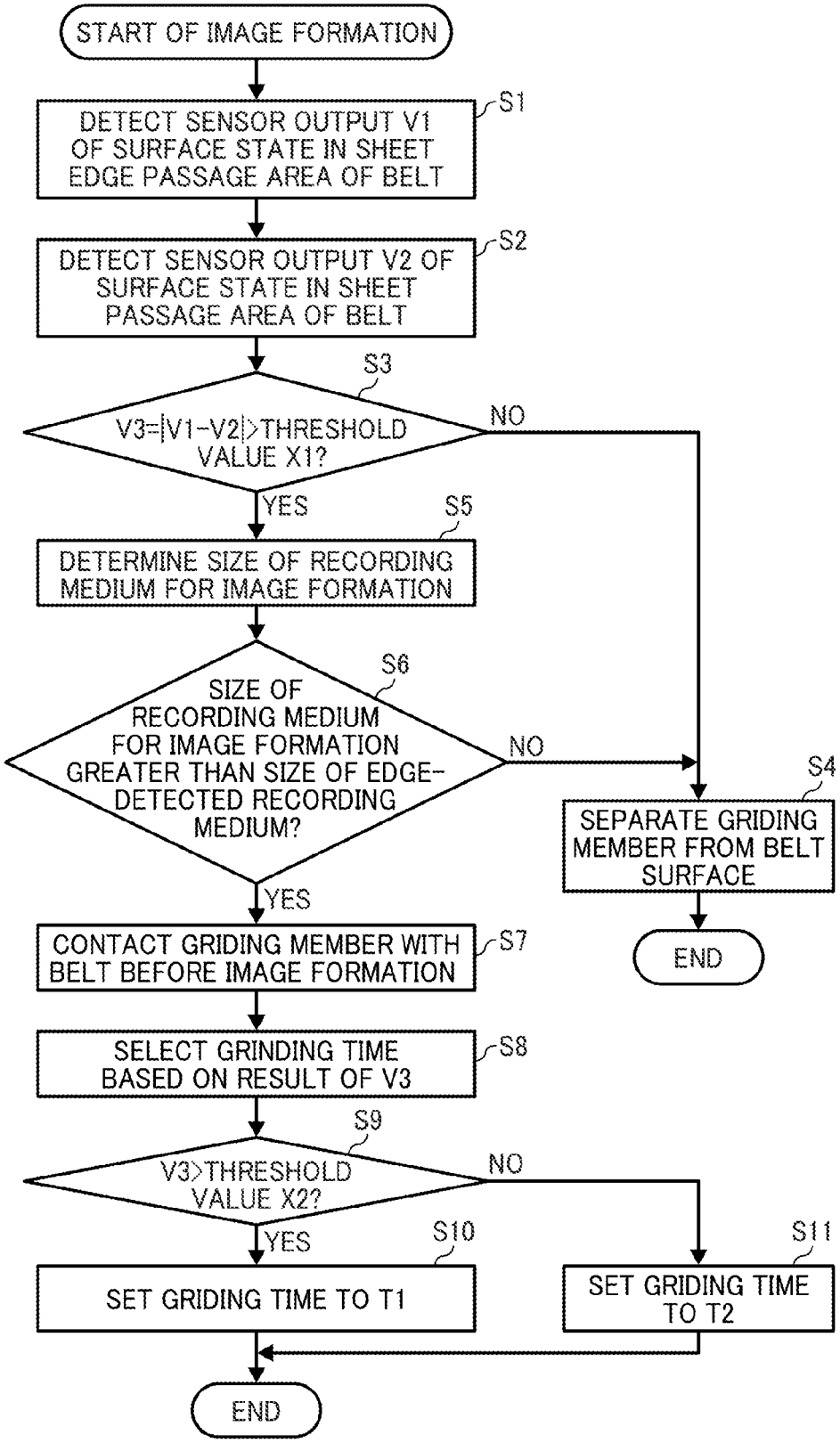
FIG. 3 is a flowchart illustrating an example of operation using the fixing device according to an embodiment of this disclosure.

The fixing device 25 of this embodiment calculates the difference value V3 between the sensor output V1 of the sheet edge area and the sensor output V2 of the sheet passage area in the fixing belt 26 as at step S3 of FIG. 3. Accordingly, it is possible to reliably recognize the surface state of the fixing belt which may cause the image failure.

Figure 5:
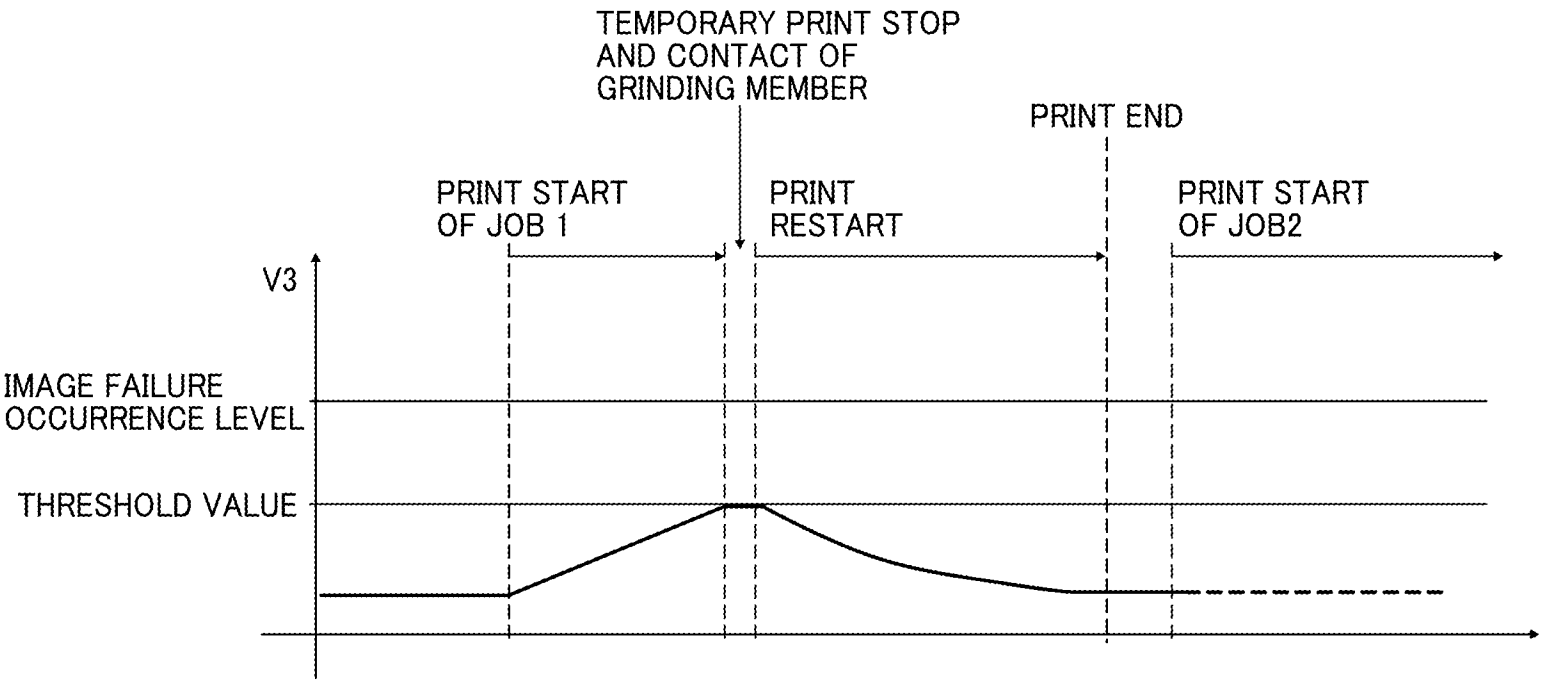
FIG. 5 is a diagram illustrating an example of relation between difference value V3 and print operation execution timing according to an embodiment of this disclosure.

FIG. 5 illustrates a relation example between the difference value V3 and the print operation execution timing by the image forming apparatus 1000. In this embodiment, when the difference value V3 is larger than a predetermined threshold value as illustrated in FIG. 5, the print operation is temporarily stopped and the grinding member 34 is caused to contact the fixing belt 26 to recover the surface state of the fixing belt 26.

In this embodiment, as described above, the state whether the difference value V3 is larger than the predetermined threshold value X1 during the detection as illustrated in FIG. 3 is used for the determination whether to cause the grinding member 34 to contact or separate from the fixing belt 26, and the state whether the difference value V3 is larger than the threshold value X2 during the detection is used for the contact time selection control. For this reason, FIG. 5 is an example illustrating whether the difference value V3 is larger than the threshold value X1. However, the contact time illustrated in FIG. 5 is selected as the time T1 or T2 depending on whether the difference value V3 is larger than the threshold value X2.

In this way, the controller 70 may cause the grinding member 34 to contact the fixing belt 26 for a predetermined time in response to the state whether the difference value V3 is larger than the predetermined threshold value X1 and the size of the recording medium. For this reason, the grinding operation may be performed only at the necessary time, and hence the grinding performance of the grinding member 34 may be maintained for a long period of time.

The fixing device 25 of this embodiment causes the grinding member 34 to contact the fixing belt before the recording medium passes through the fixing device when the difference value V3 is larger than the predetermined threshold value X1 at step S6 of FIG. 3 and the recording medium size of the subsequent passage sheet is larger than the size of the edge detection recording medium.

In this way, in this embodiment, the recording medium size of the subsequent passage sheet in a direction perpendicular to the feed direction in accordance with the rotation of the fixing member, that is, the sheet width direction is compared with the size of the passing recording medium in the sheet width direction. Then, when the size of the recording medium of the subsequent passage sheet in the sheet width direction is large, the contact of the grinding member 34 with respect to the fixing belt 26 is started before the passing recording medium completely passes through the nipping portion formed by the fixing belt 26 and the pressing roller 27.

For this reason, the grinding operation may be performed only at the necessary time, and hence the grinding performance of the grinding member 34 may be maintained for a long period of time.

The fixing device 25 of this embodiment causes the grinding member 34 to separate from the fixing belt 26 when the difference value V3 is larger than the predetermined threshold value X1 at step S6 of FIG. 3 and the recording medium size of the subsequent passage sheet is equal to or smaller than the size of the edge detection recording medium.

In this way, in this embodiment, the recording medium size of the subsequent passage sheet in a direction perpendicular to the feed direction in accordance with the rotation of the fixing member, that is, the sheet width direction is compared with the size of the passing recording medium in the sheet width direction. Then, when the size of the recording medium of the subsequent passage sheet in the sheet width direction is equal to or smaller than the size of the passing recording medium in the sheet width direction, the grinding member 34 is separated from the fixing belt 26 without contacting the fixing belt 26.

For this reason, the grinding operation may be performed only at the necessary time, and hence the grinding performance of the grinding member 34 may be maintained for a long period of time.

Further, according to the image forming apparatus 1000 including the fixing device 25 of the above-described embodiment, it is possible to provide an image forming apparatus capable of obtaining at least one of the above-described effects.

Next, another example of operation of the fixing device 25 according to an embodiment of this disclosure is described.

In this embodiment, a grinding time may be extended by repeating a control operation from detection of a sensor when the longest grinding time is selected at step S8 and step S9 of FIG. 3. The same description as that of the above-described embodiment will not be presented.

Figure 6:
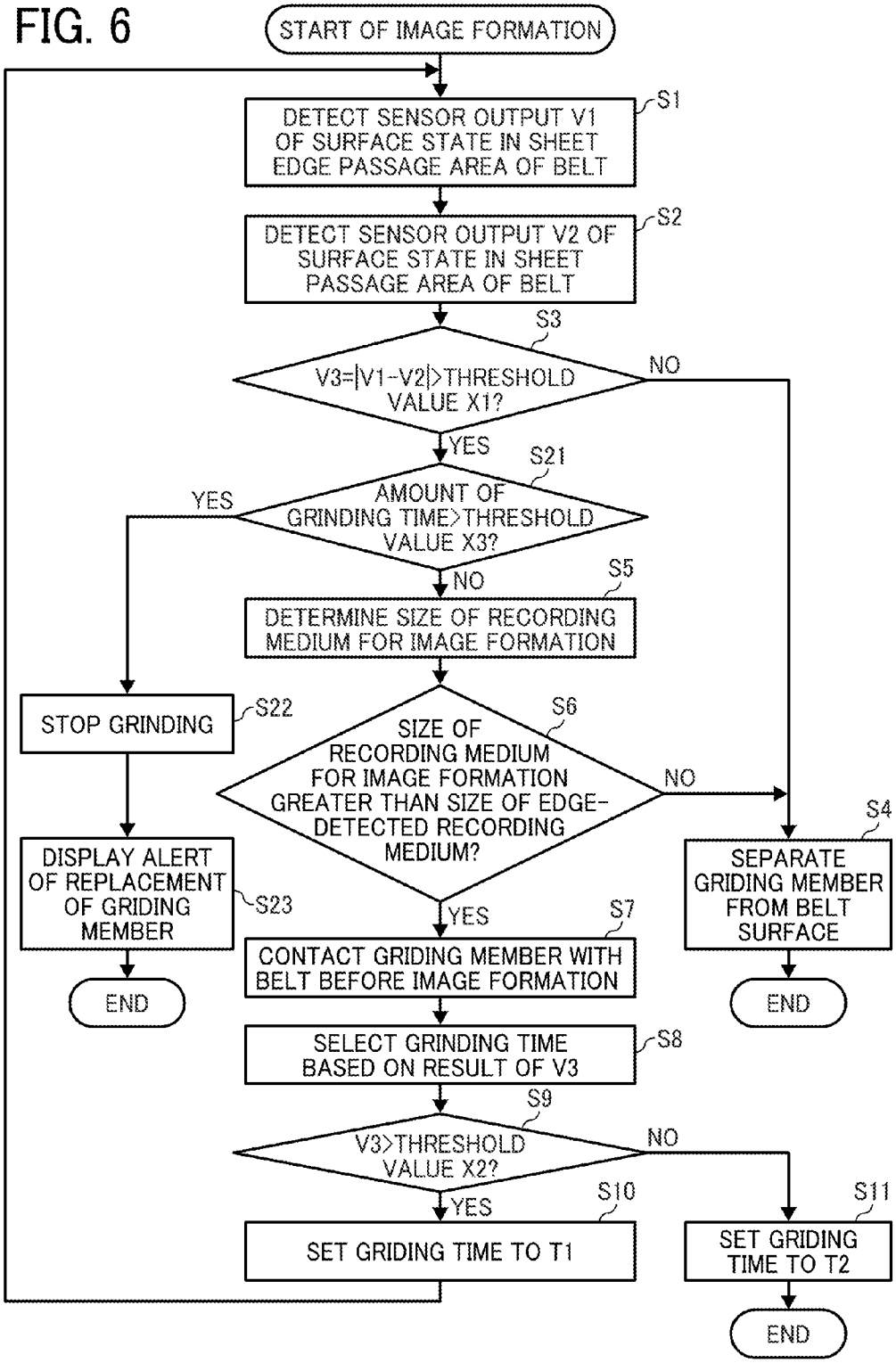
FIG. 6 is a flowchart of an example of operation using a fixing device according to an embodiment of this disclosure.

An example of operation according to this embodiment is described with reference to a flowchart of FIG. 6.

When a difference value V3 is greater than a threshold value X2 at step S9 of FIG. 3 (YES at step S9), a controller 70 first sets the grinding time to T1 and causes a grinding member 34 to contact a fixing belt 26 as described above (step S10). Then, the grinding member 34 contacts the fixing belt 26 for the grinding time T1, and the operation from step S1 is repeated while the grinding member 34 contacts the fixing belt 26. That is, a comparison with a threshold value X1 based on a sensor output at step S1 to step S3 is repeated. When the difference value V3 is not greater than the threshold value X1 after the repeating operation (NO at step S3), the grinding member 34 is separated from the surface of the fixing belt 26 as described above (step S4).

When the difference value V3 is greater than the predetermined threshold value X1 even after the repeating operation (YES at step S3), the time for which the grinding member 34 contacts the fixing belt 26 is directly extended. That is, when the difference value V3 is greater than the threshold value X2 after the repeating operation (YES at step S9), the time for which the grinding member 34 contacts the fixing belt 26 is extended by the time T1 (step S10), and the operation from step S1 is further repeated. When the difference value V3 is not greater than the threshold value X2 after the repeating operation (NO at step S9), the time for which the grinding member 34 contacts the fixing belt 26 is extended only by a time T2 shorter than the time T1, and the grinding member 34 is separated from the surface of the fixing belt 26 (step S11).

When the time for which the grinding member 34 contacts the fixing belt 26 is extended by the time T1 in this way and the total grinding time is greater than a threshold value X3 (YES at step S21), the grinding member 34 is separated from the surface of the fixing belt 26 and the grinding operation is stopped (step S22). Then, a display unit displays a notification for necessity of replacement and a replacement procedure to cause a user to replace the grinding member 34 (step S23). The display unit may be realized as, for example, an operation display unit such as a touch panel. In this way, the replacement of the grinding member 34 is notified when the total grinding time is greater than the predetermined threshold value X3, and hence the controller 70 or the display unit serves as a notification unit.

As described above, in this embodiment, the grinding time may be extended and stopped in response to the detection result of the optical sensor 33 capable of detecting both the sheet edge and the sheet passage area. In this way, since the grinding time may be extended and stopped in response to the detection result of the optical sensor 33 when the grinding time is extended by the time T1, an optimal grinding operation may be performed on the fixing belt 26.

Further, when the difference value V3 is greater than the threshold value X1 after the grinding time is extended, the grinding time is further extended. Accordingly, it is possible to perform the edge detection with higher precision and to further reduce a failure such as a gloss streak caused by the roughness of the surface of the fixing member due to the passage of the recording medium.

Further, such a configuration prevents a failure such as a gloss streak caused by the roughness of the surface of the fixing member in advance by extending the grinding time until the difference value V3 becomes equal to or smaller than the threshold value X1 when the difference value V3 is greater than the predetermined threshold value X1 after the grinding time is extended.

Further, for this embodiment, the grinding operation is stopped if the difference value V3 does not greater than the predetermined threshold value X1 after the grinding time is extended even when the grinding operation is performed for a predetermined time. Such a configuration prevents the waste of the unnecessary grinding time even when the grinding performance of the grinding member 34 is degraded.

Further, for this embodiment, the replacement of the grinding member is notified as the display or the like when the grinding operation is stopped. The notification method is not limited to the display, and may be a voice or the like. Accordingly, when the grinding function of the grinding member 34 is degraded, the notification for the replacement may be notified to a user.

Further, according to this embodiment, it is possible to provide an image forming apparatus capable of obtaining at least one of the above-described effects.

Furthermore, embodiments of this disclosure are not limited to the above-described embodiments. Various modifications may be made based on the technical spirit of the invention.

For example, in the above-described embodiment, the roughness caused by the edge of the sheet in a direction perpendicular to the feed direction of the fixing belt 26 is detected, and the grinding operation using the grinding member 34 is performed only at the necessary time. However, a control may be performed on the feed direction based on the detection. In this case, the position of the roughness in the feed direction is first detected based on the detection result of the optical sensor 33. Similarly to the above-described embodiment, the position of the roughness may be detected depending on whether a change in the detection result of the optical sensor 33 is larger than a predetermined threshold value. Then, for example, when a print operation is performed by changing the sheet from the sheet A3 to the sheet A4, the distance between the passing sheets A4 is adjusted. Accordingly, the print operation timing is controlled so that the print operation ends without using the detected roughness position in the feed direction for the fixing operation. Alternatively, the circumferential length of the fixing belt may be defined in accordance with the size of the major sheet without adjusting the distance between the passing sheets A4. When the controller 70 performs a control with such a configuration, it is possible to omit the unnecessary grinding operation using the grinding member 34 for the surface roughness in the feed direction of the fixing belt 26 in a center feed type.

Further, the optical sensor 33 of the above-described embodiment is disposed to oppose the position corresponding to the sheet width or the entire sheet width in the sheet width direction of the sheet in use. Alternatively, single or plural sensors may be disposed at a position corresponding to the end of the major sheet size. Alternatively, the optical sensor may be moved by a moving unit, for example, in the width direction so that the vicinity of the edge of the sheet is detected.

Further, in the above-described embodiment, the belt-type fixing device has been described in which the fixing member that fixes the toner image to the sheet is the fixing belt 26, but the invention is not limited to this type. For example, a roller-type fixing device using a fixing roller as a fixing member may be also realized similarly to the above-described embodiment.

Next, an embodiment of this disclosure is described below.

An image forming apparatus according to this embodiment is similar to, if not the same configuration as, the image forming apparatus illustrated in FIGS. 1 and 2. Therefore, the same reference codes as FIGS. 1 and 2 are allocated to the same or similar components of this embodiment, and redundant descriptions thereof are omitted below.

In the image forming apparatus according to the second embodiment, like the configuration illustrated in FIG. 2, a detecting device is an optical sensor 33 capable of detecting reflected light from a fixing member (fixing belt 26) with respect to emitted light in a detection unit, and the optical sensor 33 may detect both a sheet edge area and a sheet passage area of the fixing belt 26. A controller 70 is provided which causes a grinding member 34 to contact the fixing belt 26 and selects a grinding rotation speed in response to such a detection result, and the grinding rotation speed is adjustable in response to the detection result before and after a grinding operation.

As the grinding member 34, for example, a member having a file surface and capable of grinding an object is used. Further, the "surface state" indicates the surface smoothness, and the "surface roughness" indicates a state whether a surface B which is cut by the edge of the sheet is relatively "rough" with respect to a surface A which is not cut by the edge of the sheet. Like the configuration illustrated in FIG. 2, in this embodiment, the grinding member is configured to contact the surface of the fixing belt 26. At a further downstream position thereof, the detection unit (optical sensor 33) capable of detecting the surface state of the fixing belt 26 is provided. The optical sensor 33 detects the surface roughness of the fixing belt 26 by detecting the sheet edge passage area and the sheet passage area of the fixing belt 26. Furthermore, the controller 70 is provided which causes the grinding member to contact or separate from the fixing belt 26 and selects a grinding time in response to the size of the recording medium during the print operation. An image failure caused by the sheet edge may occur when the surface of the fixing belt 26 is roughened by the sheet edge so that the sheet passing portion and the edge have different surface states and gloss changes between the edge and the sheet passing portion. Thus, it is possible to detect the roughness of the surface of the fixing belt by the intensity of the reflected light with respect to the emitted light by using the optical sensor 33 as the detection unit (like the configurations illustrated in FIGS. 4A and 4B). In this embodiment, the image forming apparatus also includes the controller 70 to cause the grinding member 34 to contact or separate from the fixing belt 26 and selects the grinding time. The controller 70 is provided so that the grinding member 34 contacts the fixing belt 26 and selects the grinding time in response to the detection result of the optical sensor 33, and the grinding rotation speed is adjustable in response to the detection result before and after the grinding operation. Accordingly, since the controller 70 is provided which causes the grinding member 34 to contact the fixing member and selects the grinding time in response to the detection result and the grinding rotation speed is changeable in response to the detection result before and after the grinding operation, the fixing belt 26 may be optimally grinded.

Further, in this embodiment, like the configuration illustrated in FIGS. 4A and 4B, when the detection result of the recording medium edge of the optical sensor 33 is indicated by V1 and the detection result of the sheet passing portion is indicated by V2, the difference value is set to $V3=|V2-V1|$. When the difference value V3 is larger than a predetermined threshold value or the difference value V3 is not larger than a predetermined threshold value even after the grinding operation performed by the controller 70 which causes the grinding member 34 to contact the fixing belt 26 and selects the grinding time in response to the size of the recording medium, the grinding rotation speed is increased. Accordingly, when the difference value V3 is larger than the predetermined threshold value after the grinding operation, the grinding rotation speed is increased. Thus, it is possible to highly precisely detect the edge and to reduce a failure such as a gloss streak caused by the roughness of the surface of the fixing belt generated by the passage of the recording medium.

Such a configuration can reliably recognize the surface state of the fixing belt 26 which may cause an image failure by calculating the difference value V3 between the output V1 of the optical sensor 33 of the sheet edge of the fixing belt 26 and the detection result V2 as the optical sensor output of the sheet passage area. Furthermore, the controller 70 is provided which causes the grinding member to contact or separate from the fixing belt 26 and selects a grinding time in response to the size of the recording medium during the print operation. When the difference value V3 after the grinding operation is larger than the predetermined threshold value, the grinding rotation speed is increased.

Figure 7:
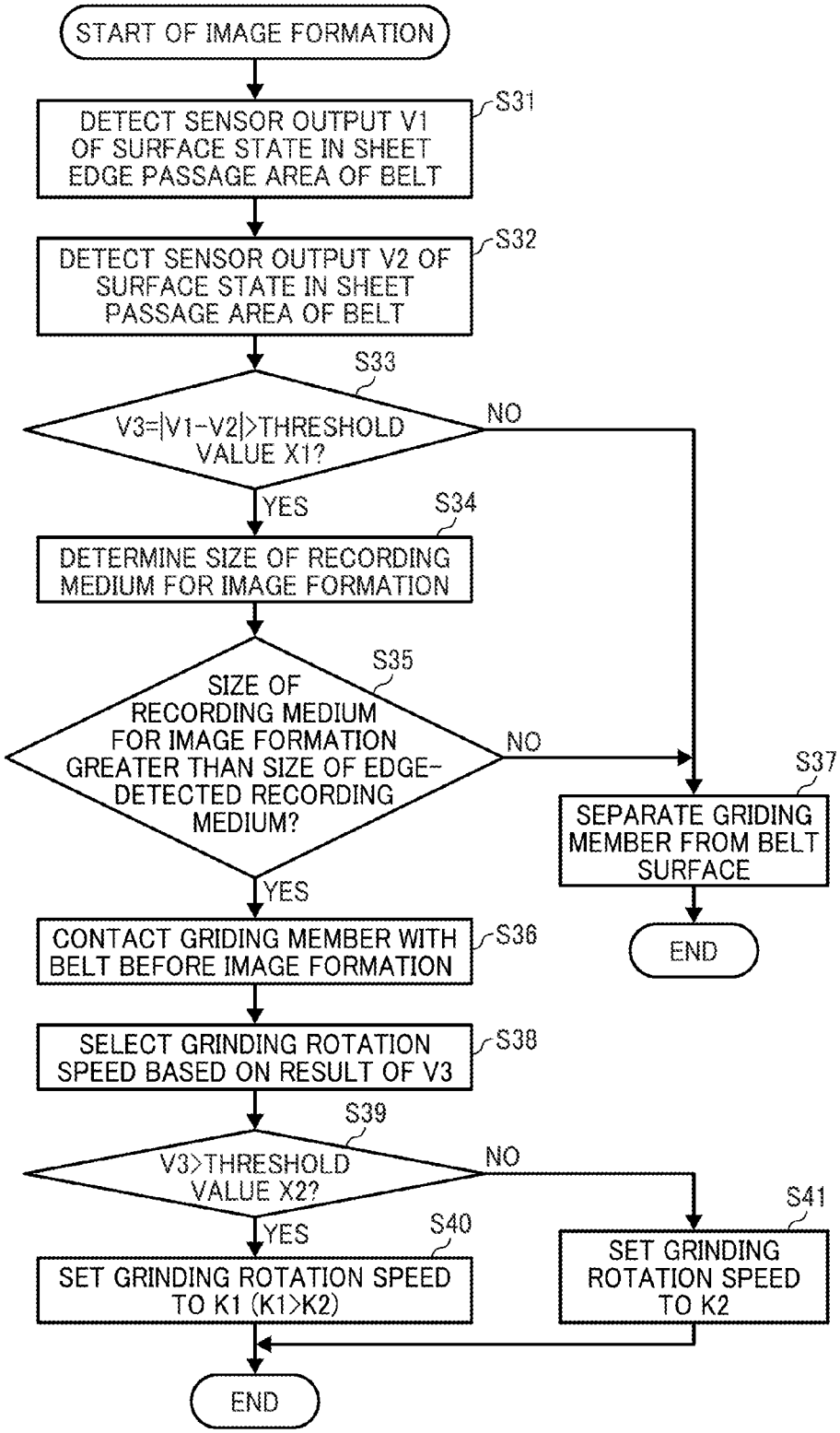
FIG. 7 is a flowchart of an example of operation using a fixing device according to an embodiment of this disclosure.

Here, FIG. 7 is described. FIG. 7 is a flowchart of an example of the operation. When image formation starts, an output V1 is detected as a sensor output of a surface state in the sheet edge passage area of the fixing belt 26 (step S31).

Then, an output V2 is detected as a sensor output of a surface state in the sheet passage area of the fixing belt 26 (step S32). At step S33, the controller 70 determines whether |V1−V2| as the difference value V3 is greater than a threshold value X1. When the difference value V3 is greater than the threshold value X1 (YES at step S33), the controller 70 determines the size of a recording medium for image formation (step S34). At step S35, the controller 70 determines whether the size of the recording medium for image formation is greater than the size of an edge-detected recording medium (step S35). When the size of the recording medium having the image is greater than the size of the edge-detected recording medium (YES at step S35), the grinding member 34 contacts an image forming area (step S36), and the process goes to step S38. When the difference value V3 is not greater than the threshold value X1 (NO at step S33) and the size of the recording medium for image formation is not greater than the size of the edge-detected recording medium (NO at step S35), the controller 70 causes the grinding member 34 to separate from the surface of the fixing belt 26 (step S37). At step S39, the controller 71 determines whether the difference value V3 is greater than a threshold value X2. When the difference value V3 is greater than the threshold value X2 (YES at step S39), the controller 71 sets the grinding rotation speed to K1 (K1>K2) (step S40). When the difference value V3 is not greater than the threshold value X2 (NO at step S39), the controller 71 sets the grinding rotation speed to K2.

Further, when the difference value V3 is not larger than a predetermined threshold value, the controller 71 may increase the grinding rotation speed and perform the grinding operation until the grinding rotation speed becomes equal to smaller than the threshold value. Such a configuration prevents a failure such as a gloss streak caused by the roughness of the surface of the fixing member.

Further, the controller 70 may stop the grinding operation when the grinding rotation speed does not become equal to or smaller than the threshold value even after the grinding operation is performed for a predetermined time. Such a configuration prevents waste of the grinding time even when the grinding function of the grinding member is degraded.

Further, the replacement of the grinding member may be displayed after the grinding operation is stopped. Such a configuration allows notification of replacement timing even when the grinding function of the grinding member is degraded.

Figure 8:
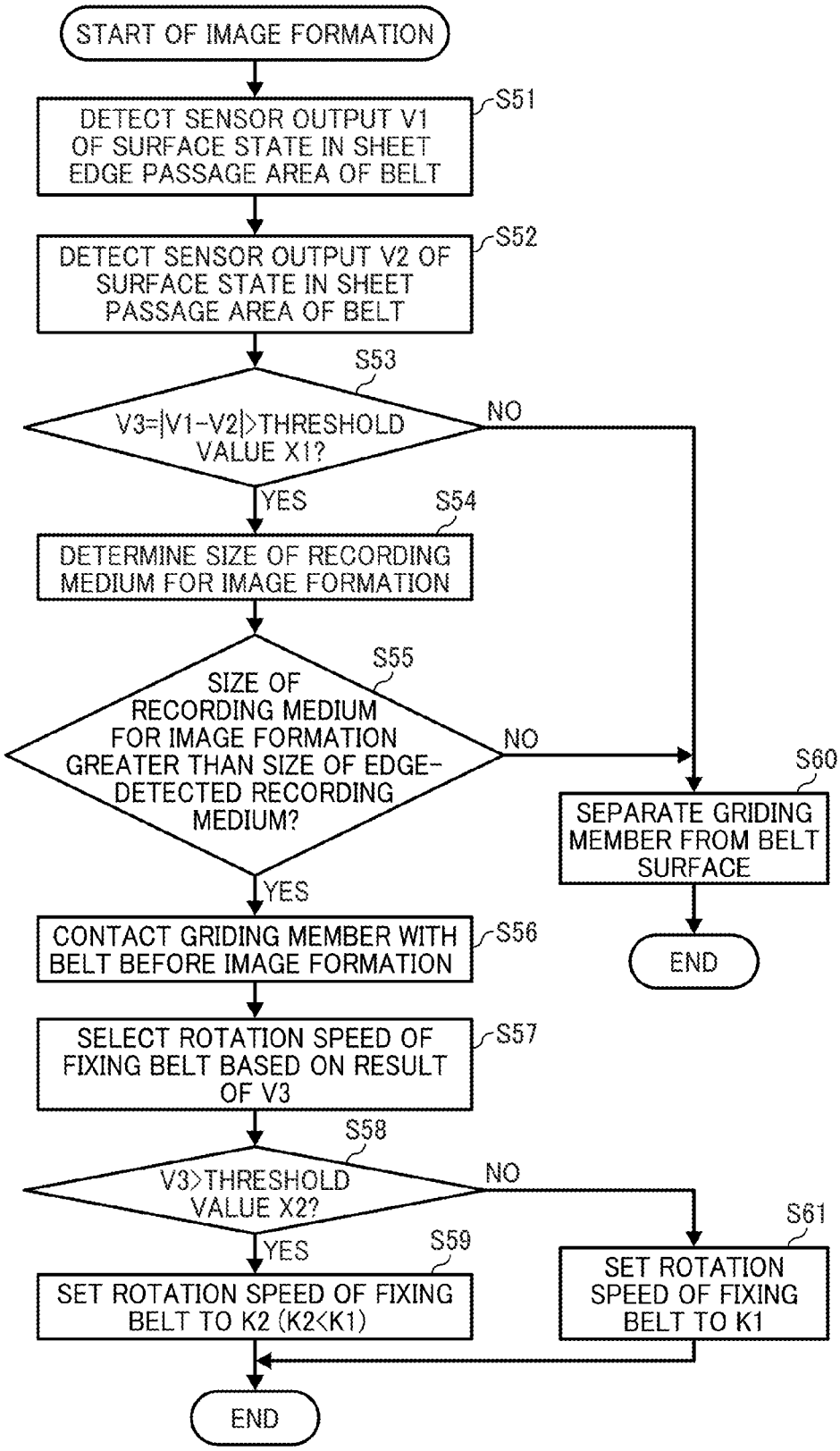
FIG. 8 is a flowchart of an example of operation of a fixing device according to an embodiment of this disclosure.

Next, an embodiment of this disclosure is described with reference to FIG. 8. FIG. 8 is a flowchart illustrating an example of operation according to this embodiment. When image formation starts, an output V1 is detected as a sensor output of a surface state in the sheet edge passage area of the fixing belt 26 (step S51). An output V2 is detected as a sensor output of a surface state in the sheet edge passage area of the fixing belt 26 (step S52). It is determined whether V3=|V1−V2| is greater than a threshold value X1 (step S53). When a relation of V3=|V1−V2|>threshold value X1 is established (YES at step S53), the controller 70 determines the size of a recording medium for image formation (step S54). At step S55, the controller 70 determines whether the size of the recording medium for image formation is greater than the size of an edge-detect recording medium. When the size of the recording medium for image formation is greater than the size of the edge-detected recording medium (YES at step S55), the controller 70 causes the grinding member 34 to contact the fixing belt 26 before the image formation (step S56), and selects the rotation speed of the fixing belt 26 depending on the result of whether the difference value V3 is greater than the threshold value X1 (the rotation speed K1: step S57). When the difference value V3 is not greater than the threshold value X1 (NO at step S53) and the size of the recording medium for image formation is greater than the size of the edge-detected recording medium (NO at step S55), the controller 70 causes the grinding member 34 to separate from the surface of the fixing belt 26 (step S60). At S58, the controller 70 determines whether the difference value V3 is greater than a threshold value X2. When the difference value V3 is greater than the threshold value X2 (YES at step S58), the controller 70 sets the rotation speed of the fixing belt 26 to K2 (K2<K1) (step S59). By contrast, when the difference value V3 is not greater than the threshold value X2 (NO at step S58), the controller 70 sets the rotation speed of the fixing belt 26 to K1 (step S61).

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device, comprising:

a rotary fixing member to fix an image on a recording medium;

a sensor to detect a surface roughness of the rotary fixing member;

a grinder disposed opposite the rotary fixing member to slide against a surface of the rotary fixing member and grind the surface of the rotary fixing member; and a controller to control the grinder to contact or separate from the rotary fixing member, in accordance with a detection result of the surface roughness detected with the sensor in a recording medium edge passage area of the rotary fixing member over which an edge of a recording medium passes in a direction perpendicular to a feed direction of the recording medium fed with rotation of the rotary fixing member.

2. The fixing device according to claim 1, wherein the controller selects a time for which the grinder contacts the rotary fixing member from a plurality of predetermined time values or a grinding rotation speed of the grinder, in accordance with the detection result of the surface roughness detected with the sensor in the recording medium edge passage area of the rotary fixing member.

3. The fixing device according to claim 2, wherein when a longest time is selected from the plurality of predetermined time values, the controller repeats detection of the surface roughness with the sensor while the grinder contacts the rotary fixing member and extends the time for which the grinder contacts the rotary fixing member in response to results of the detection, and wherein, where V1 is a detection result of the edge of the recording medium detected with the sensor, V2 is a detection result of a passage area, V3 is a difference value expressed by |V2−V1|, when the difference value V3 is greater than a threshold value, the controller controls the grinder to contact the rotary fixing member for a grinding operation and selects a grinding time in accordance with a size of a recording medium, and when the difference value V3 is not greater than the threshold value after the grinding operation, the controller increases the grinding rotation speed.

4. The fixing device according to claim 3, wherein, when a total time for which the grinder contacts the rotary fixing member is greater than a predetermined time, the controller separates the grinder from the rotary fixing member or, if the total time is greater than the predetermined time and V3 is not greater than the threshold value, the controller performs a grinding operation at an increased grinding rotation speed until V3 becomes equal to or smaller than the threshold value, and wherein, when V3 is greater than the threshold value after the grinding operation is performed at the increased grinding rotation speed for a predetermined time, the controller stops the grinding operation and displays a notification of replacement of the grinder.

5. The fixing device according to claim 1, further comprising:

a notification unit to notify a need for replacement of the grinder, wherein, when a total time for which the grinder contacts the rotary fixing member is greater than a predetermined time, the controller controls the notification unit to notify the need for replacement of the grinder.

6. The fixing device according to claim 1, wherein the sensor detects the surface roughness of the rotary fixing member in an area including at least a passage area of the recording medium and the recording medium edge passage area in the direction perpendicular to the feed direction, and wherein the controller controls the grinder to contact or separate from the rotary fixing member, in accordance with the detection result of the surface roughness detected with the sensor in the recording medium edge passage area by comparing a detection result of the surface roughness in the passage area of the recording medium with the detection result of the surface roughness in the recording medium edge passage area detected with the sensor.

7. The fixing device according to claim 1, wherein the controller controls the grinder to separate from the rotary fixing member when a difference between a detection result of the surface roughness in a passage area of the recording medium and the detection result of the surface roughness in the recording medium edge passage area detected with the sensor is not greater than a threshold value.

8. The fixing device according to claim 1, wherein, when a difference between a detection result of the surface roughness in a passage area of the recording medium and the detection result of the surface roughness in the recording medium edge passage area detected with the sensor is greater than a threshold value and a size of a subsequent recording medium in the direction perpendicular to the feed direction is greater than a size of a recording medium being passing the fixing device, the controller starts to contact the grinder with the rotary fixing member before the recording medium being passing the fixing device passes out from the fixing device.

9. The fixing device according to claim 1, wherein, when a difference between a detection result of the surface roughness in a passage area of the recording medium and the detection result of the surface roughness in the recording medium edge passage area detected with the sensor is greater than a threshold value and a size of a subsequent recording medium in the direction perpendicular to the feed direction is not greater than a size of a recording medium being passing the fixing device, the controller controls the grinder to separate from the rotary fixing member.

10. An image forming apparatus comprising:

an image forming unit to form an image; and the fixing device according to claim 1 to fix the image on the recording medium.

11. A fixing device, comprising:

a rotary fixing member to fix an image on a recording medium;

a sensor to detect a surface roughness of the rotary fixing member;

a grinder disposed opposite the rotary fixing member to slide against a surface of the rotary fixing member and grind the surface of the rotary fixing member; and a controller to control the grinder to contact or separate from the rotary fixing member, wherein the controller changes a rotation speed of the rotary fixing member in a grinding operation in response to a detection result of the surface roughness before and after the grinding operation.

12. The fixing device according to claim 11, wherein the controller selects a time for which the grinder contacts the rotary fixing member from a plurality of predetermined time values or a grinding rotation speed of the grinder, in accordance with a detection result of the surface roughness detected with the sensor in a recording medium edge passage area of the rotary fixing member over which an edge of a recording medium passes in a direction perpendicular to a feed direction of the recording medium fed with rotation of the rotary fixing member.

13. The fixing device according to claim 12, wherein when a longest time is selected from the plurality of predetermined time values, the controller repeats detection of the surface roughness with the sensor while the grinder contacts the rotary fixing member and extends the time for which the grinder contacts the rotary fixing member in response to results of the detection, and wherein, where V1 is a detection result of the edge of the recording medium detected with the sensor, V2 is a detection result of a passage area, V3 is a difference value expressed by $|V2-V1|$, when the difference value V3 is greater than a threshold value, the controller controls the grinder to contact the rotary fixing member for a grinding operation and selects a grinding time in accordance with a size of a recording medium, and when the difference value V3 is not greater than the threshold value after the grinding operation, the controller increases the grinding rotation speed.

14. The fixing device according to claim 13, wherein, when a total time for which the grinder contacts the rotary fixing member is greater than a predetermined time, the controller separates the grinder from the rotary fixing member or, if the total time is greater than the predetermined time and V3 is not greater than the threshold value, the controller performs a grinding operation at an increased grinding rotation speed until V3 becomes equal to or smaller than the threshold value, and wherein, when V3 is greater than the threshold value after the grinding operation is performed at the increased grinding rotation speed for a predetermined time, the controller stops the grinding operation and displays a notification of replacement of the grinder.

15. The fixing device according to claim 11, further comprising:

a notification unit to notify a need for replacement of the grinder, wherein, when a total time for which the grinder contacts the rotary fixing member is greater than a predetermined time, the controller controls the notification unit to notify the need for replacement of the grinder.

16. The fixing device according to claim 11, wherein the sensor detects the surface roughness of the rotary fixing member in an area including at least a passage area of the recording medium and a recording medium edge passage area in a direction perpendicular to a feed direction of the recording medium fed with rotation of the rotary fixing member, and wherein the controller controls the grinder to contact or separate from the rotary fixing member, in accordance with a detection result of the surface roughness detected with the sensor in the recording medium edge passage area by comparing a detection result of the surface roughness in the passage area of the recording medium with the detection result of the surface roughness in the recording medium edge passage area detected with the sensor.

17. The fixing device according to claim 11, wherein the controller controls the grinder to separate from the rotary fixing member when a difference between a detection result of the surface roughness in a passage area of the recording medium and a detection result of the surface roughness in a recording medium edge passage area detected with the sensor in a direction perpendicular to a feed direction of the recording medium fed with rotation of the rotary fixing member is not greater than a threshold value.

18. The fixing device according to claim 11, wherein, when a difference between a detection result of the surface roughness in a passage area of the recording medium and the detection result of the surface roughness in a recording medium edge passage area detected with the sensor in a direction perpendicular to a feed direction of the recording medium fed with rotation of the rotary fixing member is greater than a threshold value and a size of a subsequent recording medium in the direction perpendicular, to the feed direction is greater than a size of a recording medium being passing the fixing device, the controller starts to contact the grinder with the rotary fixing member before the recording medium being passing the fixing device passes out from the fixing device.

19. The fixing device according to claim 11, wherein, when a difference between a detection result of the surface roughness in a passage area of the recording medium and the detection result of the surface roughness in a recording medium edge passage area detected with the sensor in a direction perpendicular to a feed direction of the recording medium fed with rotation of the rotary fixing member is greater than a threshold value and a size of a subsequent recording medium in the direction perpendicular to the feed direction is not greater than a size of a recording medium being passing the fixing device, the controller controls the grinder to separate from the rotary fixing member.

20. An image forming apparatus comprising:

an image forming unit to form an image; and the fixing device according to claim 11 to fix the image on the recording medium.

* * * * *